US006599411B2

(12) United States Patent
Dinan et al.

(10) Patent No.: US 6,599,411 B2
(45) Date of Patent: Jul. 29, 2003

(54) METHOD OF ELECTROPLATING A NICKEL-IRON ALLOY FILM WITH A GRADUATED COMPOSITION

(75) Inventors: Thomas Edward Dinan, San Jose, CA (US); Neil Leslie Robertson, Palo Alto, CA (US); Alan Jun-Yuen Tam, Berkeley, CA (US)

(73) Assignee: Hitachi Global Storage Technologies Netherlands, B.V., Amsterdam (NL)

( * ) Notice: Subject to any disclaimer, the term of this patent is extended or adjusted under 35 U.S.C. 154(b) by 104 days.

(21) Appl. No.: 09/839,901

(22) Filed: Apr. 20, 2001

(65) Prior Publication Data

US 2002/0153255 A1 Oct. 24, 2002

(51) Int. Cl.[7] ..... C25D 5/18

(52) U.S. Cl. ..... 205/102; 205/103; 205/104; 205/105; 205/922; 205/238; 205/255

(58) Field of Search ..... 205/102, 103, 205/104, 105, 922, 238, 255

(56) References Cited

U.S. PATENT DOCUMENTS

| | | | | |
|---|---|---|---|---|
| 4,652,348 A | | 3/1987 | Yahalom et al. | 204/40 |
| 4,666,567 A | * | 5/1987 | Loch | 204/229.3 |
| 4,869,971 A | | 9/1989 | Nee et al. | 428/635 |
| 5,570,251 A | | 10/1996 | Shinoura et al. | 360/126 |
| 6,025,978 A | | 2/2000 | Hoshi et al. | 360/113 |

FOREIGN PATENT DOCUMENTS

| | | |
|---|---|---|
| JP | 1180994 A | 7/1989 |
| JP | 4297004 | 10/1992 |

OTHER PUBLICATIONS

IBM Technical Disclosure Bulletin, vol. 38 No. 07 Jul. 1995 entitled: "Permalloy Plating Bath with Improved Composition Control".

* cited by examiner

*Primary Examiner*—Roy King
*Assistant Examiner*—Wesley A. Nicolas
(74) *Attorney, Agent, or Firm*—Robert O. Guillot; IPLO Intellectual Property Law Offices

(57) ABSTRACT

In the NiFe electroplating method of the present invention, the atomic percent (at. %) composition of Ni and Fe in NiFe electroplated material is controlled by selection of the duty cycle of the electroplating current during the electroplating process. Generally, for a particular electroplating bath, where the electroplating current duty cycle is greatest the NiFe electroplated material has a higher Fe at. %, and where the electroplating current duty cycle is reduced, a lower Fe at. %. Therefore, electroplated NiFe components from a single electroplating bath can have differing NiFe concentrations where the electroplating current duty cycle is altered. Additionally, NiFe components can be electroplated with a graduated or changing Ni and Fe concentration by altering the electroplating current duty cycle during the electroplating process.

14 Claims, 3 Drawing Sheets

METHOD OF ELECTROPLATING A NICKEL-IRON ALLOY FILM WITH A GRADUATED COMPOSITION

BACKGROUND OF THE INVENTION

1. Field of the Invention

The present invention relates generally to methods for electroplating nickel-iron components of devices such as magnetic heads, and more particularly to methods for altering the composition of a plated nickel-iron component during the electroplating process by altering the electroplating process parameters.

2. Description of the Prior Art

Devices, such as magnetic heads, include various components that are composed of a NiFe compound. Such components include magnetic shields and magnetic pole pieces. While these components are composed of a NiFe compound, the differing applications and purposes that these components fulfill are advantageously achieved with differing NiFe compositions; that is compositions in which the atomic percent of Ni and Fe differ. For instance, NiFe 80/20 (permalloy) is generally suited best for magnetic shields and magnetic poles, while NiFe 45/55 is a preferable composition for a P2 pole tip piece.

Typically, where various components composed of NiFe 45/55 and NiFe 80/20 are desired in a device, two separate plating baths are utilized, each having a different chemical makeup. The present invention is a method for using a single plating bath and selecting or altering the composition of the plated NiFe component by selecting or altering the electroplating process parameters. A component having a particular NiFe composition or a graduated NiFe composition can thereby be plated from a single electroplating bath in a single electroplating process of the present invention.

SUMMARY OF THE INVENTION

In the NiFe electroplating method of the present invention, the atomic percent (at. %) composition of Ni and Fe in NiFe electroplated material is controlled by selection of the duty cycle of the electroplating current during the electroplating process. Generally, for a particular electroplating bath, where the electroplating current duty cycle is greatest the NiFe electroplated material has a higher Fe at. %, and where the electroplating current duty cycle is reduced, a lower Fe at. %. Therefore, electroplated NiFe components from a single electroplating bath can have differing NiFe concentrations where the electroplating current duty cycle is altered. Additionally, NiFe components can be electroplated with a graduated or changing Ni and Fe concentration by altering the electroplating current duty cycle during the electroplating process.

It is an advantage of the electroplating process of the present invention that NiFe components having differing concentrations of Ni and Fe can be electroplated from a single NiFe electroplating bath.

It is another advantage of the electroplating process of the present invention that NiFe components having differing concentrations of Ni and Fe can be electroplated from a single NiFe electroplating bath, utilizing a differing duty cycle of the electroplating current.

It is a further advantage of the electroplating process of the present invention that an NiFe component can be electroplated with a graduated concentration of Ni and Fe.

It is yet another advantage of the electroplating process of the present invention that an NiFe component can be electroplated with a graduated concentration of Ni and Fe, wherein the duty cycle of the electroplating current is changed during the electroplating process.

These and other features and advantages of the present invention will no doubt become apparent to those skilled in the art upon reading the following detailed description which makes reference to the several figures of the drawings.

IN THE DRAWINGS

DETAILED DESCRIPTION OF THE PREFERRED EMBODIMENTS

Many devices, particularly magnetic heads for use in hard disk drives, include components that are created in an electroplating process. Components such as magnetic shields and magnetic poles are typically composed of electroplated NiFe, and the magnetic characteristics of these elements are determined by the relative composition of the Ni and Fe in the plated component. Generally, magnetic shields and magnetic poles are advantageously composed of NiFe 80/20 (permalloy) which is a relatively low stress, low magnetostriction compound that has good magnetic flux conduction properties. However, the pole tip of the second magnetic pole of a magnetic head, typically referred to as a P2 pole tip, is advantageously composed of a NiFe 45/55 composition, wherein the higher quantity of Fe (as compared to permalloy) creates superior magnetic flux conduction properties. In devices that include NiFe components that have different compositions (such as 80/20 and 45/55) it has previously been necessary to utilize two different electroplating baths in order to plate up the NiFe components with the differing compositions. As is described herebelow, the present invention utilizes a single electroplating bath with a variation in the electroplating process parameters that controls the composition of the plated NiFe component.

As is known to those skilled in the art, a standard NiFe electroplating bath, also known as a Watts bath, typically includes compounds such as nickel chloride, nickel sulfate, iron chloride and iron sulfate, with a typical plating current of approximately 8.0 mA/cm$^2$. The electroplating process is conducted with the current on, and the composition of the plated up material is generally dependent upon the percentage concentration of Ni and Fe ions within the electroplating bath. Significantly, the inventors hereof have determined that varying the duty cycle of the plating current can result in a variation in the relative composition of Ni and Fe within the electroplated material. The duty cycle of the electroplating current is easily described with the aid of FIG. 1, which depicts an electroplating current pulse train.

Figure 1:
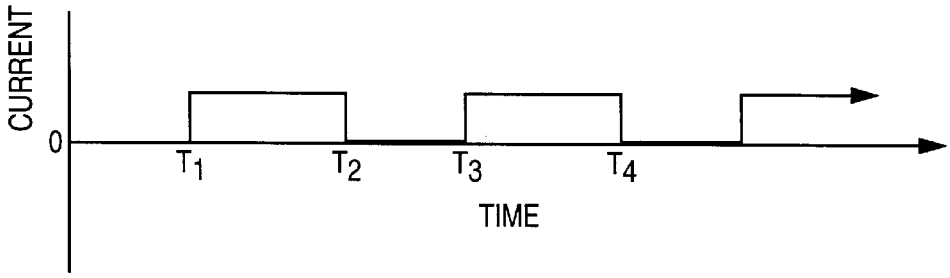
FIG. 1 is a graph which depicts an electroplating current profile that is utilized in the present invention.

As depicted in FIG. 1, the electroplating current of the present invention is preferably though not necessarily a square wave, in which the current is on at time T1, off at time T2, on again time T3 and off again at T4, for a continuing repeated pulse train. Thus the current-on time is T2 minus T1, the current-off time is T3 minus T2, and the pulse period is the on time plus the off time (T3−T1). The duty cycle in pulse plating is defined as the current on time divided by the pulse period and represents the percentage of time during a pulse period that the electroplating current is on. That is, Duty Cycle=(T2−T1)/(T3−T1).

Figure 2:
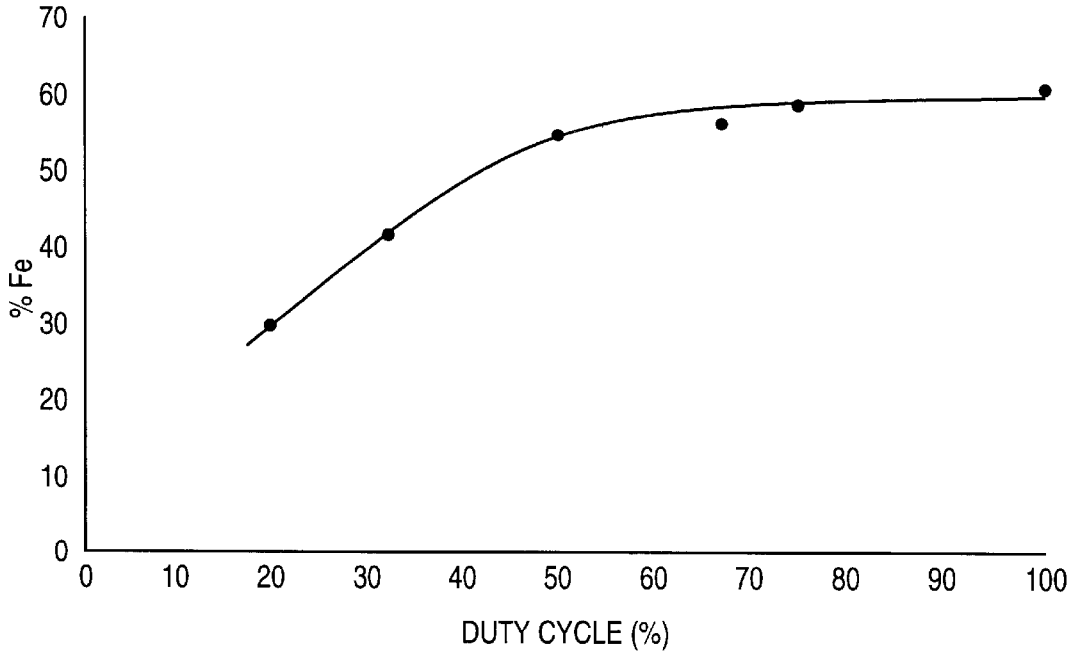
FIG. 2 is a graph depicting the relationship between the percentage of Fe in plated NiFe material as a function of duty cycle.

The variation in the percentage of Fe in the plated material as a function of duty cycle is generally depicted in the graph of FIG. 2. As is seen in FIG. 2, the percentage of Fe in the plated NiFe material is lowest when the duty cycle is lowest, and greatest when the duty cycle is greatest. The reasons for the variations in the plated NiFe composition with the duty cycle are complex and may include such effects as the dissolving of plated Fe during the off portion of the duty cycle at a greater rate than plated Ni, and differences in the diffusion of Ni and Fe ions within the plating bath during the current-on and current-off portions of the duty cycle. However, a significant feature of the present invention is that electroplated material having differing Ni and Fe compositions can be controllably obtained from a single NiFe plating bath chemistry by altering the electroplating current duty cycle.

The electroplating process of the present invention was employed in the experimental fabrication of electroplated layers upon two glass substrate wafers (A and B) with an electroplating bath of approximately 0.20 M Ni ions and 0.02 M Fe ions, and an electroplating current density of approximately 8 mA/cm$^2$. Each electroplating process was commenced with a 100% duty cycle which was then decreased. The following analysis of the electroplated layers on the wafers (A and B) thus commences with the top surface of the layers, where the Fe concentration is the lowest as the duty cycle was lowest at the end of the electroplating process.

Figure 3:
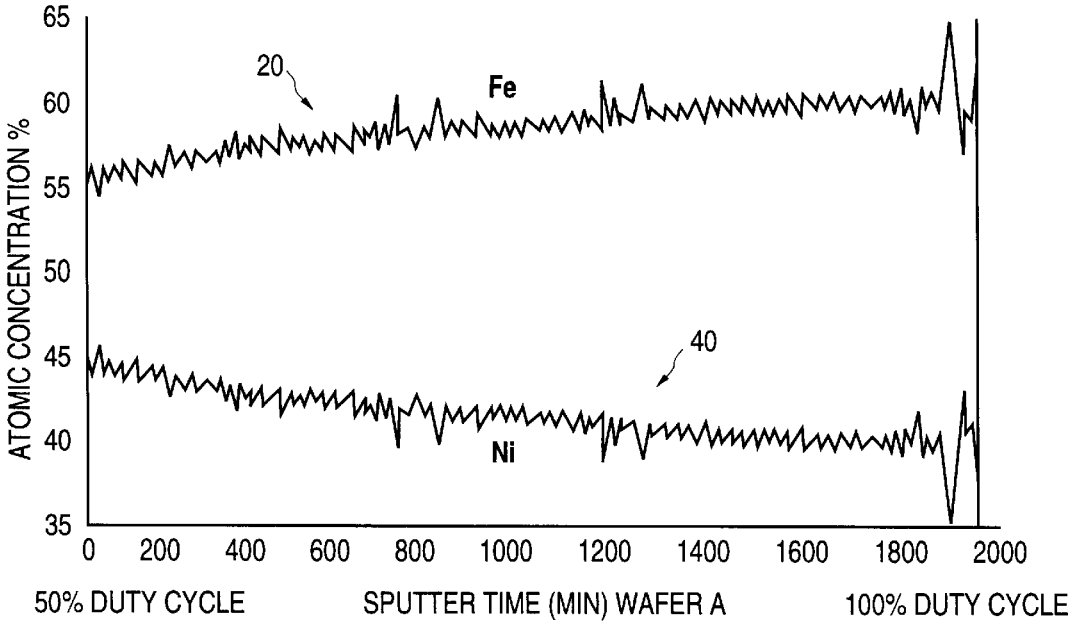
FIG. 3 is a graph depicting experimental results of electroplated NiFe material due to variation in the electroplating current duty cycle.
Figure 4:
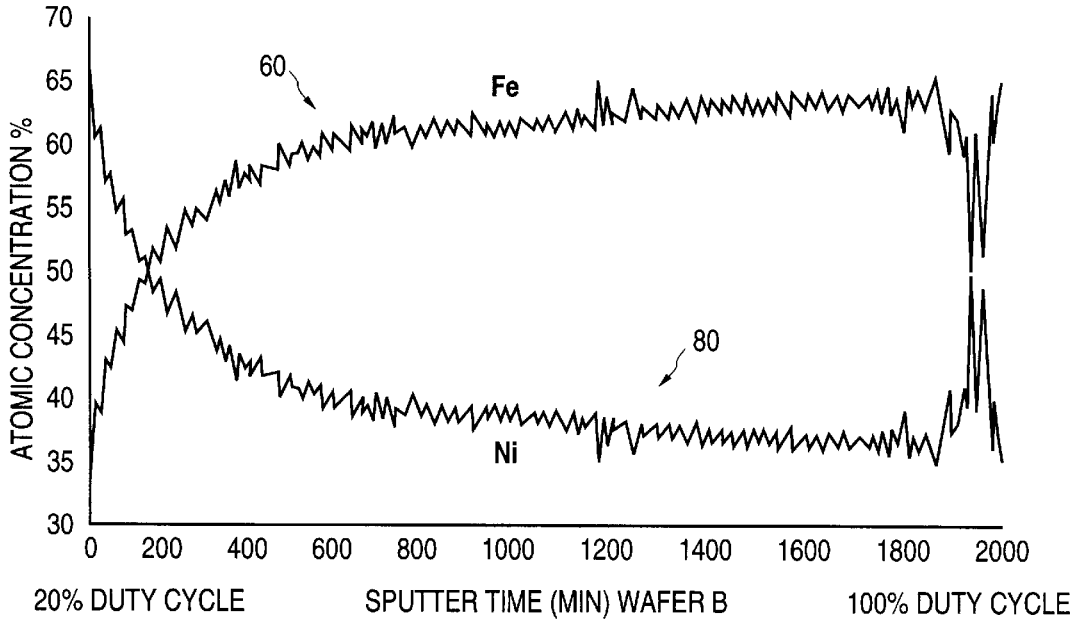
FIG. 4 is a graph depicting experimental results of electroplated NiFe material due to variation in the electroplating current duty cycle.

The two wafers, A and B, were analyzed using Auger Electron Spectroscopy to determine the NiFe composition as a function of height within the electroplated material, and FIGS. 3 and 4 are graphs depicting the experimental results for electroplated NiFe material layers on wafers A and B respectively. As depicted in FIG. 3, wafer A (duty cycle change of 100% to 50%) had an Fe concentration (line 20) ranging from about 55 at. % at the top of the electroplated material layer (duty cycle 50%) to 60 at. % at the bottom of the electroplated material layer next to the glass substrate (duty cycle 100%), with the Ni concentration (line 40) having corresponding values. As depicted in FIG. 4, wafer B (duty cycle change of 100% to 20%) had an Fe concentration (line 60) ranging from about 35 at. % at the top of the electroplated material (duty cycle of 20%) to 60 at. % at the bottom of the electroplated material layer next to the glass substrate (duty cycle 100%), with the Ni concentration (line 80) having corresponding values. Analysis was carried out on a Phi-680 AES instrument, using elemental depth profiles (with rotation). The atomic concentration scale is based on assumed sensitivity factors for the Ni and Fe transitions monitored. The spike to 65 wt. % Fe reading at the bottom of the electroplated material layer is due to the seedlayer/plated material interface and is not thought to be a true electroplated material layer composition.

Figure 5:
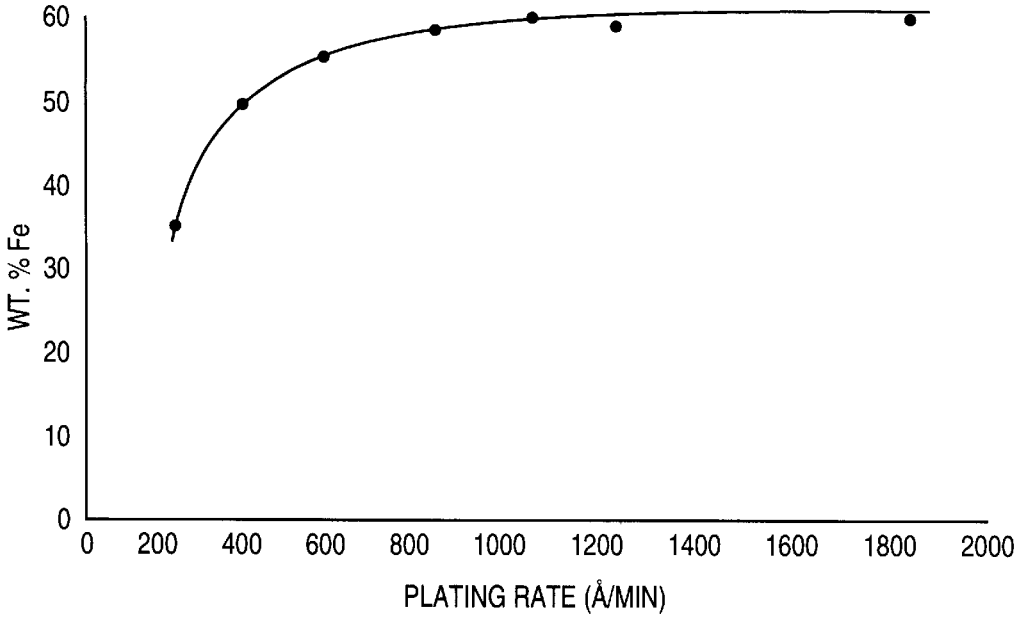
FIG. 5 is a graph depicting the relationship between Fe concentration in plated NiFe material as a function of the plating rate.
Figure 6:
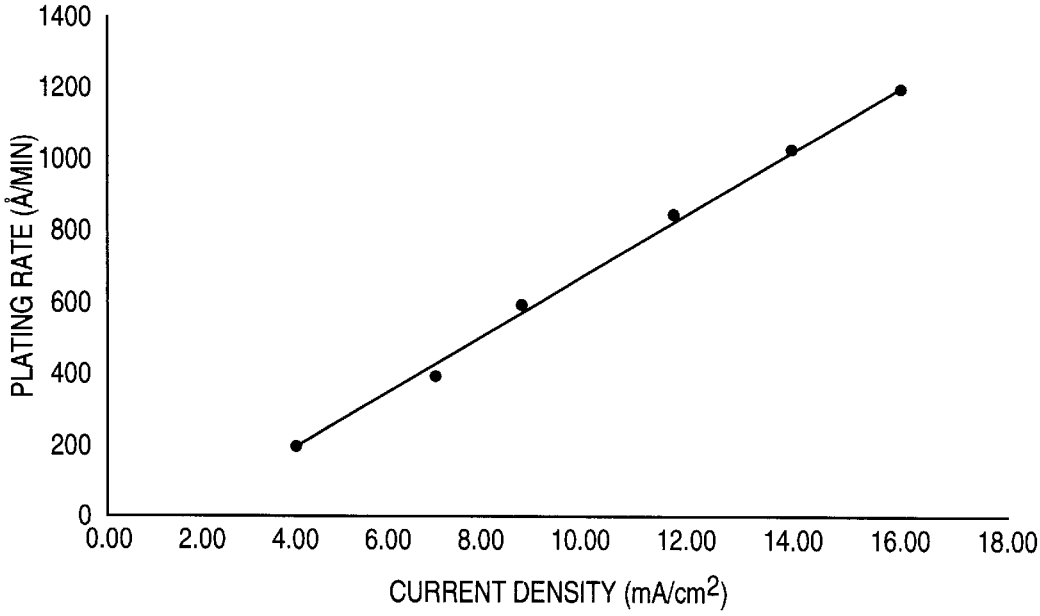
FIG. 6 is a graph depicting the relationship between the plating rate and the electroplating current density.

Variation in other electroplating parameters can also have an effect upon the percentage of Fe in the electroplated material. Specifically, FIG. 5 is a graph depicting the change in the percentage of Fe in the plated material as a function of the plating rate. It is generally seen that as the plating rate increases from approximately 200 Å per minute to approximately 600 Å per minute that the percentage of Fe increases from approximately 35% to approximately 55%. Thereafter, increasing the plating rate does not significantly affect the percentage of Fe, which remains at approximately 55 to 58% With regard to the plating rate, FIG. 6 is a graph depicting the relationship between the plating rate and the plating current density. As can be seen, there is generally a linear relationship between the plating rate and the plating current density. Therefore, selection of a plating current density operates to determine the plating rate and thus a percentage of Fe in the electroplated material, where the duty cycle is 100%. Thereafter, where the duty cycle is varied, as depicted in FIGS. 2, 3 and 4, the percentage of Fe in the electroplated material can likewise be varied. In general, the electroplating current density range that is suitable for the present invention is from 1 mA/cm$^2$ to 30 mA/cm$^2$, with a preferred range of 4 mA/cm$^2$ to 16 mA/cm$^2$, and with a more preferred value of approximately 8 mA/cm$^2$. An electroplating bath of the present invention has Ni ion and Fe ion concentrations in the range of from 5:1 Ni:Fe to 20:1 Ni:Fe ions, with a preferred concentration range of approximately 10:1 Ni:Fe.

In addition to varying the electroplating current duty cycle as described hereabove, the pulse period can also be varied, as will be understood by those skilled in the art. Experimentation by the inventors in this regard has generally revealed that a variation in the pulse period, while maintaining the same duty cycle, did not result in a significant change in the percentage of Fe deposited. Therefore, the duty cycle is a significant electroplating parameter for determining the composition of the electroplated material, while variation in the pulse period is generally not a significant electroplating parameter.

While the invention has been shown and described with regard to certain preferred embodiments, it is to be understood that those skilled in the art will no doubt develop certain alterations and modifications therein, it is therefore intended that the following claims cover all such alterations and modifications that nevertheless include the true spirit and scope of the invention.

What we claim is:

1. A method for electroplating a NiFe material upon a substrate, wherein the percentage of iron in the plated NiFe material is varied, comprising the steps of:

varying the duty cycle of an electroplating current that is utilized in an electroplating apparatus during an electroplating process, thereby electroplating said NiFe material upon the substrate; and wherein said NiFe material is plated with a higher percentage of Fe when said duty cycle is greatest, and a lower percent Fe when said duty cycle is lowest.

2. A method for electroplating a NiFe material as described in claim 1 wherein an electroplating bath within said electroplating apparatus has Ni and Fe ion concentrations in the range of 5:1 Ni:Fe to 20:1 Ni:Fe.

3. A method for electroplating a NiFe material as described in claim 1 wherein an electroplating bath within said electroplating apparatus has a NiFe ion concentration ratio of approximately 10:1 Ni:Fe.

4. A method for electroplating a NiFe material as described in claim 1 wherein current density of said electroplating current is from 1 mA/cm$^2$ to 30 mA/cm$^2$.

5. A method for electroplating a NiFe material as described in claim 4 wherein current density of said electroplating current is from 4 mA/cm$^2$ to 16 mA/cm$^2$.

6. A method for electroplating a NiFe material as described in claim 5 wherein the current density of said electroplating current is approximately 8 $mA/cm^2$.

7. A method for electroplating a NiFe material as described in claim 1 wherein the percentage of Fe in said NiFe material varies from approximately 20 wt. % to approximately 60 wt. %.

8. A method for electroplating a material with a NiFe composition, comprising the steps of:

immersing a substrate in an electroplating bath of an electroplating apparatus, said electroplating bath including Ni ions and Fe ions;

passing an electrical current through said electroplating bath to cause said Ni ions and said Fe ions to be plated onto said substrate;

pulsing said electrical current such that said electrical current has a pulse period including a current-on time and a current-off time, whereby said electrical current has a duty cycle defined as the current-on time divided by the pulse period; and wherein the percentage of Fe within said NiFe plated material is a function of said duty cycle, such that said NiFe material is plated with a higher percentage of Fe when said duty cycle is greatest, and a lower percent Fe when said duty cycle is lowest.

9. A method for electroplating a material as described in claim 8 wherein said duty cycle is varied to vary the percentage Fe in said NiFe plated material during said electroplating process.

10. A method for electroplating a material as described in claim 9 wherein said electroplating bath has Ni and Fe ion concentrations in the range of 5:1 Ni:Fe to 20:1 Ni:Fe.

11. A method for electroplating a material as described in claim 10 wherein the current density of said electroplating current is in the range of from 1 $mA/cm^2$ to 30 $mA/cm^2$.

12. A method for electroplating a material as described in claim 10 wherein the current density of said electroplating current is in the range of from 4 $mA/cm^2$ to 16 $mA/cm^2$.

13. A method for electroplating a material as described in claim 8 wherein said electroplating bath has a NiFe ion concentration ratio of approximately 10:1 Ni:Fe.

14. A method for electroplating a material as described in claim 13 wherein the current density of said electroplating current is approximately 8 $mA/cm^2$.

* * * * *

UNITED STATES PATENT AND TRADEMARK OFFICE

CERTIFICATE OF CORRECTION

PATENT NO. : 6,599,411 B2 
DATED : July 29, 2003
INVENTOR(S) : Thomas Edward Dinan et al.

It is certified that error appears in the above-identified patent and that said Letters Patent is hereby corrected as shown below:

Title page,
Item [73], Assignee, is changed to -- International Business Machines Corporation, Armonk, N.Y. --

Signed and Sealed this

Twenty-second Day of June, 2004

JON W. DUDAS
*Acting Director of the United States Patent and Trademark Office*